United States Patent [19]

Pelton

[11] 3,989,061

[45] Nov. 2, 1976

[54] CYLINDRICAL PRESSURE REGULATOR

[75] Inventor: Peter G. Pelton, Carol Stream, Ill.

[73] Assignee: The Continental Group, Inc., New York, N.Y.

[22] Filed: June 2, 1975

[21] Appl. No.: 583,084

[52] U.S. Cl. ..... 137/505; 137/505.38; 137/505.41

[51] Int. Cl.[2] ..... F16K 31/12

[58] Field of Search ..... 137/505, 505.23, 505.38, 137/505.39, 505.41

[56] References Cited

UNITED STATES PATENTS

| | | | |
|---|---|---|---|
| 198,862 | 1/1878 | Thompson | 137/505 |
| 711,282 | 10/1902 | Burnett | 137/505.38 |
| 1,640,620 | 8/1927 | Shaft | 137/505 X |
| 1,658,951 | 2/1928 | Stitt | 137/505.41 |
| 2,024,780 | 12/1935 | Ruckman | 137/505.39 X |
| 2,888,033 | 5/1959 | Eickmeyer | 137/505 |
| 2,894,532 | 7/1959 | Gaylord | 137/505 |
| 3,045,704 | 7/1962 | Williams | 137/505.41 X |
| 3,229,714 | 1/1966 | Raem | 137/505.41 |

*Primary Examiner*—Harold W. Weakley
*Attorney, Agent, or Firm*—Joseph E. Kerwin; John J. Kowalik; Paul J. Lerner

[57] ABSTRACT

A pressure regulator particularly adaptable for use in aerosol cans, in which a chamber is provided having inlet and outlet ports, and a dimensionally changeable, hollow pressure reactive element located within the chamber is dimensionally controlled, to close and open the inlet port, by variations of pressure in the chamber.

1 Claim, 4 Drawing Figures

1
2
3
4
4a
4b
4c
5
6
7
8
9
10

CYLINDRICAL PRESSURE REGULATOR

SUMMARY OF THE INVENTION

The present invention relates to a new and useful fluid pressure regulator and more particularly to a pressure regulator adaptable for use in aerosol cans.

Currently, the vast majority of the aerosol cans utilize fluorohydrocarbon propellants. Propellant, in liquid form, is enclosed in the can body, wherein a portion vaporizes and pressurizes the container. As product is dispersed, further propellant vaporizes, thereby maintaining the dispensing force at a constant level.

Great concern has recently been expressed concerning the possible deleterious effects upon the atmosphere of these propellants. Several alternate pressurizing media have been proposed, including compressed gases such as nitrogen, carbon dioxide and air. These media, however, are commercially unacceptable because the dispensing force produced decreases as the product is dispensed.

Accordingly, the primary object of the present invention is to provide an improved pressure regulator which will maintain a constant dispensing force in an aerosol can pressurized with a compressed gas.

It is a further object of the invention to provide an improved pressure regulator which is compact and operable in any orientation.

It is another object of the present invention to provide an improved pressure regulator which is inexpensive and easily manufactured.

With the above and other objects in view that will hereinafter appear, the nature of the invention will be clearly understood by reference to the following description, the claims and the several views illustrated in the accompanying drawings.

Figures 1, 2, 3:
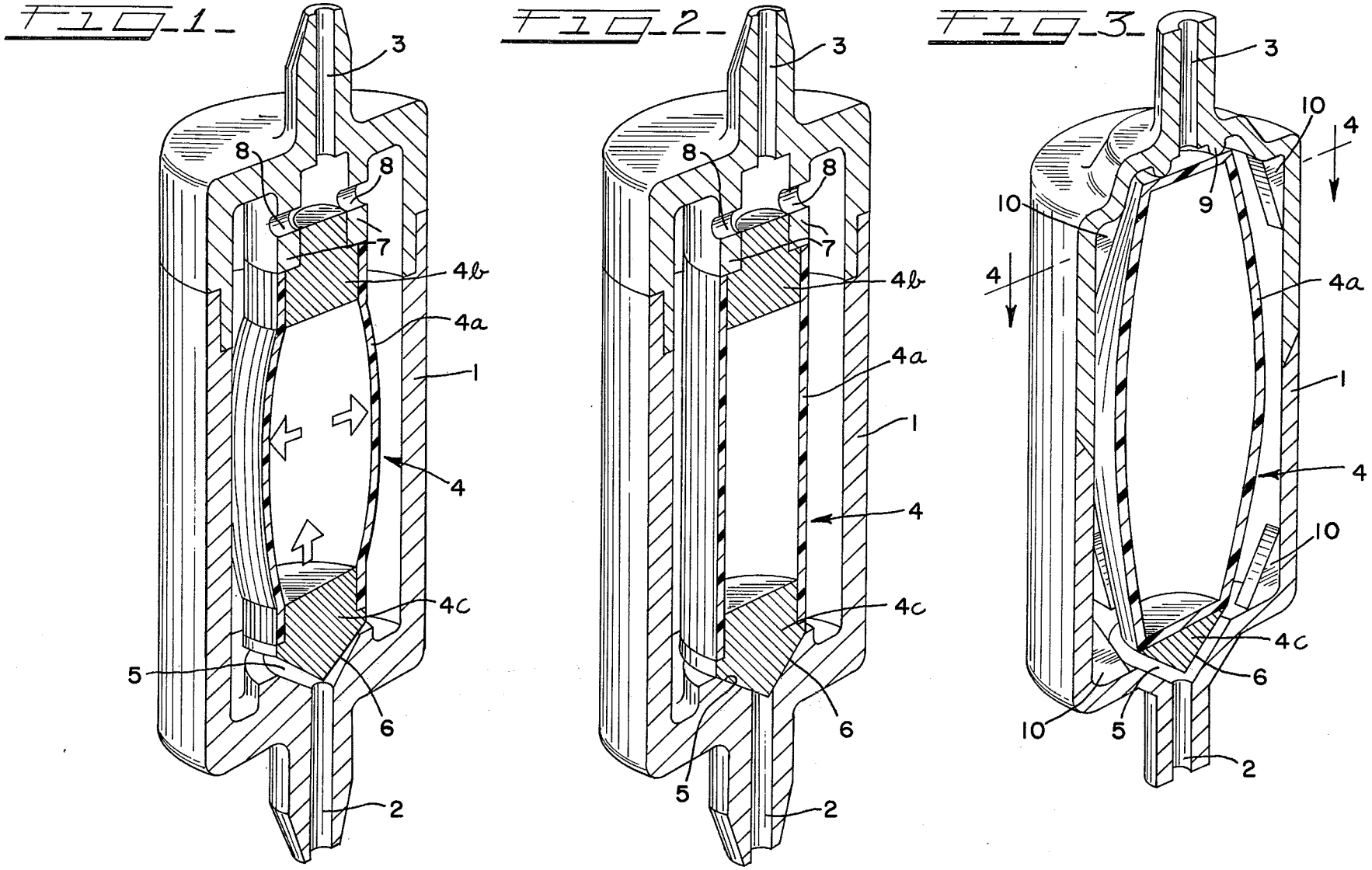
FIG. 1 is a diametrical, cross-sectional view of a pressure regulator showing the pressure reactive body in the distorted condition.
FIG. 2 is a diametrical, cross-sectional view similar to FIG. 1, showing the pressure reactive body in the relaxed condition.
FIG. 3 is a diametrical, cross-sectional view of an alternate construction of the invention.

DESCRIPTION OF THE PREFERRED EMBODIMENT (FIGS. 1 and 2)

In keeping with the present invention, there is provided a hollow, substantially cylindrical regulator body having inlet and outlet connections 2 and 3 respectively and an internally mounted pressure reactive body 4 controlling flow through the inlet 2.

The pressure reactive body 4 is a hollow, gas-filled, pressurized member comprising a substantially cylindrical body wall **4*a* and upper and lower end portions 4*b* and 4*c* respectively. The wall 4*a* is formed of an elastomeric material having axially disposed flexible, inextensible members, such as fine metal wires embedded therein. The end portions 4*b* and 4*c* are substantially rigid and meet the body wall 4*a*** in a pressure-tight seal.

The pressure reactive body 4 is supported by a retaining member which grips the upper end portion **4*b*. The retaining member 7 is integrally formed on the interior of the regulator body 1, encircling the inner terminus of the outlet connection 3. Ports 8 formed in the retaining member communicate between the interior of the regulator body 1 and the outlet connection 3**.

A substantially conical valve orifice 5 is formed in the inner terminus of the inlet connection 2 and a mating valve seat 6 is formed in the distal end of the lower end portion **4*c***.

In operation, the dispensing valve (not shown) on the outlet connection 3 is initially closed and the pressure reactive body 4 is in the undistorted condition, as shown in FIG. 2, with the valve seat 6 seated against the valve orifice 5, thereby closing the inlet connection 2.

The pressure on both sides of the body wall **4*a* is in equilibrium. When the dispensing valve is opened, the pressure within the regulator body 1 drops as the contents pass through the ports 8 and out the outlet connection 3. As the pressure in the regulator body 1 drops, the body wall 4*a* of the pressure reactive body 4 bulges outwardly, as shown in FIG. 1, increasing the internal volume of the reactive body 4 and thereby decreasing the internal pressure (Boyle's Law) to reestablish the pressure equilibrium. As the inextensible body wall 4*a* bulges, the lower end portion 4*c* is pulled inwardly, thereby drawing the valve seat 6 from the valve orifice 5 and admitting high pressure contents from the source (not shown). As the pressure in the regulator body 1 increases, the bulging of the body wall 4*a* subsides, urging the valve seat 6 toward the orifice 5, thereby decreasing the flow rate from the source and maintaining a constant pressure within the regulator body 1 at a level substantially equal to the pressure within the reactive body 4** in its undistorted state.

When the dispensing valve is closed, the pressure in the regulator body 1 increases, causing the reactive body 4 to reassume the undistorted configuration as shown in FIG. 2, blocking flow from the source.

Figure 4:
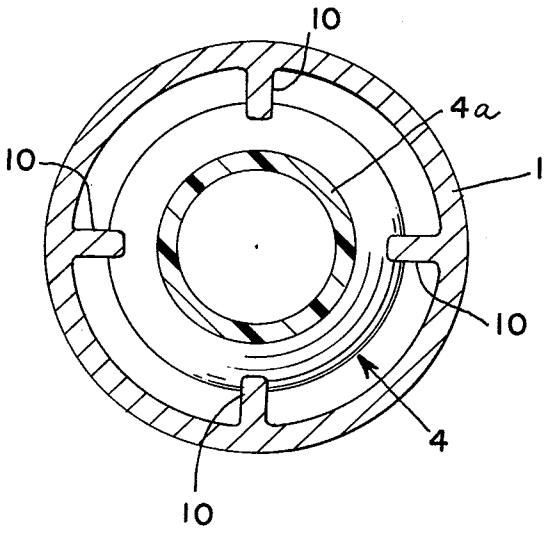
FIG. 4 is a cross-sectional view taken along line 4—4 of FIG. 3.

DESCRIPTION OF THE FIGS. 3 and 4

This pressure regulator differs from the first described construction in that the pressure reactive body 4 is, to a limited extent, free-floating within the regulator body 1. In place of the retaining member 7, a ring of spaced standoff ridges 9 encircles the inner terminus of the outlet connection 3 and prevent the upper end portion **4*b* from blocking the outlet connection 3. Locator ridges 10, formed on the interior of the regulator body 1, serve to maintain the pressure reactive body in approximate alignment relative to the inlet and outlet connections 2 and 3**.

Experiments indicate that use of a pressure reactive body of the type included in the present invention in place of conventional diaphragm allows a 75 percent reduction in the base dimensions of pressure regulators without sacrifice of operational characteristics.

While several preferred forms and arrangements of parts have been shown in illustrating the invention, it is to be clearly understood that various changes in details and arrangement of parts may be made without departing from the scope and spirit of this disclosure.

I claim:

1. An improved pressure regulator comprising a hollow chamber having inlet and outlet means for admitting and exhausting pressurized fluid through the chamber, a pressure reactive body within said chamber member, valve means on said inlet means, said valve means being operable by said pressure reactive body in response to the pressure of said fluid in said chamber member to open and close said inlet valve means to maintain said pressure of said fluid in said chamber member at a predetermined level, said pressure reactive body having a major axis and said body being axisymmetric with respect to said axis, said pressure reactive body being extensible along said major axis in response to pressure changes within said chamber member, said pressure reactive body comprising a hollow, fluid-filled member having first and second end portions and flexible wall means, said wall means being reformable in response to pressure changes in said chamber member, the axial separation of said end portions being proportioned to the pressure in said chamber member, said valve means comprising a valve orifice on said inlet means and a co-operative valve seat on said first end portion of said pressure reactive body, said valve means being controlled by axial extension of said pressure reactive body, said wall means of said pressure reactive body being displaced radially consequent to pressure changes in said chamber member, whereby said pressure in said pressure-reactive body is maintained in substantial balance with the pressure in said chamber member, and support means maintaining said pressure reactive body in spaced relation with said outlet means whereby an unobstructed exit is provided from said chamber member, said wall of said pressure reactive body being formed of an elastomeric material, said fluid filling said reactive body being in the gaseous state, said wall member having flexible, inelastic constraint members axially disposed therein, said support means comprising a plurality of standoff ridges formed within said chamber member adjacent said outlet means and co-operating with said second end portion of said pressure reactive body, said standoff ridges being spaced to permit flow therebetween.

* * * * *